US007117975B2

(12) United States Patent
Matoba

(10) Patent No.: US 7,117,975 B2
(45) Date of Patent: Oct. 10, 2006

(54) ELEVATED LOCATION DESCENT APPARATUS

(76) Inventor: Tuyosi Matoba, 1-11, Shimabashiminamino-cho, Wakayama-shi, Wakayama 640-8415 (JP)

( * ) Notice: Subject to any disclaimer, the term of this patent is extended or adjusted under 35 U.S.C. 154(b) by 324 days.

(21) Appl. No.: 10/343,108

(22) PCT Filed: Jul. 27, 2001

(86) PCT No.: PCT/JP01/06494

§ 371 (c)(1),
(2), (4) Date: Jul. 21, 2003

(87) PCT Pub. No.: WO02/09816

PCT Pub. Date: Feb. 7, 2002

(65) Prior Publication Data

US 2004/0011591 A1 Jan. 22, 2004

(30) Foreign Application Priority Data

Jul. 27, 2000 (JP) ..... 2000-226858
Jun. 14, 2001 (JP) ..... 2001-179828

(51) Int. Cl.
*A62B 1/00* (2006.01)

(52) U.S. Cl. ..... 182/238; 182/43

(58) Field of Classification Search ..... 182/42, 182/43, 44, 233, 238
See application file for complete search history.

(56) References Cited

U.S. PATENT DOCUMENTS 204,581 A * 6/1878 Knight et al. ..... 182/43
537,383 A * 4/1895 Buckelew ..... 182/42
780,795 A * 1/1905 Hansen et al. ..... 182/44
879,439 A * 2/1908 Campbell ..... 182/43
931,040 A * 8/1909 Cooke ..... 182/43

(Continued)

FOREIGN PATENT DOCUMENTS

FR 2268539 A 11/1975

(Continued)

*Primary Examiner*—Alvin Chin-Shue
(74) *Attorney, Agent, or Firm*—Knobbe, Martens, Olson & Bear, LLP

(57) ABSTRACT

An elevated location descent apparatus comprising a descending device, a braking device and a power transmitting device; the descending device comprising sprockets positioned in a vertical plane, a suspension chain positioned around the sprockets and a payload-suspending means attached to the suspension chain, the braking device comprising a fluid pump converting the rotational movement of a crankshaft into the reciprocal movement of pistons, which reciprocal movement causes the fluid pump to receive a fluid from an inlet and discharge the fluid through an outlet, a fluid circulating conduit connecting the outlet of the fluid pump with the inlet of the fluid pump wherein the fluid discharged from the fluid pump circulates, a flow-restricting valve adjusting the amount of the fluid passing through the outlet of the fluid pump to generate the fluid resistance, and a rotational governor controlling the flow-restricting valve based on the rotational speed of the sprocket; the power transmitting device comprising a transmission means that transmits the rotational force of the sprocket of the descending device to the crankshaft of the braking device; and the elevated location descent apparatus being designed to apply braking force to the rotation of the sprocket of the descending device by controlling the flow-restricting valve through the use of the rotational governor to vary the fluid resistance applied to the compression movement of the pistons in accordance with the speed of the sprocket generated by the weight of a payload when the payload is attached to the suspension chain.

18 Claims, 6 Drawing Sheets

U.S. PATENT DOCUMENTS

| | | | | | |
|---|---|---|---|---|---|
| 3,095,946 | A * | 7/1963 | Fisher | 182/43 | |
| 4,512,438 | A * | 4/1985 | Vilchek et al. | 182/43 | |
| 4,570,750 | A * | 2/1986 | Tsai | 182/44 | |
| 4,653,609 | A * | 3/1987 | Devine | 182/238 | |

FOREIGN PATENT DOCUMENTS

| | | |
|---|---|---|
| JP | 50-117297 A | 9/1975 |
| JP | 59-741 B2 | 1/1984 |

* cited by examiner

ELEVATED LOCATION DESCENT APPARATUS

RELATED APPLICATIONS

This application is the U.S. National Phase under 35 U.S.C. §371 of International Application PCT/JP01/06494, filed Jul. 27, 2001, which claims priority to Japanese Patent Applications Nos. 2000-226858 and 2001-179828, filed Jul. 27, 2000 and Jun. 14, 2001, respectively. The International Application was published under PCT Article 21(2) in a language other than English.

TECHNICAL FIELD

The present invention relates to an elevated location descent apparatus that can be used for conveying an escaper from an elevated location such as a building or the like to a lower, safe location in the event of an emergency or the like, and that can also be used for conveying cargo.

BACKGROUND OF THE INVENTION

Japanese Examined Patent Application Nos. 19999/1971, 111066/1974 and 741/1984 disclose building escape apparatuses wherein a braking device incorporates a gear pump in a pulley for escape at a safe descending speed; a wire rope or chain, which is wound around the pulley body and used to suspend the apparatus, mounts to a suitable place on a building, and a gondola removably connects to the free end of the wire rope or the like.

Japanese Examined Patent Application Nos. 5479/78, 26856/1995, etc., disclose braking devices employing pistons provided in cylinders.

However, it is difficult to continually lower and evacuate many people in a short period of time using the inventions disclosed above. Japanese Examined Patent Application No. 26656/1995, for example, discloses a device wherein an endless loop ladder is used. In consideration of adult height and other chracteristics, however, the number of individuals that can be lowered is limited. In the event of an emergency, such as a disaster, people rush to an escape apparatus. Therefore, it is necessary to suspend and lower as many people as possible per unit length of rope or chain. The inventions described above do not satisfy this need.

It is an object of the present invention to provide an elevated location descent apparatus that satisfies the need described above, and, moreover, has a simple structure, operates space-efficiently, necessitates no power source, and, due to the use of fluid resistance, is subject to little friction-caused wear in its parts.

SUMMARY OF THE INVENTION

The present invention, in order to achieve the above objectives, comprises a descending device, a braking device and a power transmitting device. The descending device comprises sprockets positioned in a vertical plane, a suspension chain positioned around the sprockets, and a payload-suspending means clamping the suspension chain. The braking device comprises a fluid pump that converts the rotational motion of a crankshaft into the reciprocal motion of pistons, which reciprocal movement causes the fluid pump to receive a fluid from an inlet and discharge it through an outlet; a fluid circulating conduit that connects the outlet of the fluid pump with the inlet of the fluid pump wherein the fluid discharged from the fluid pump circulates; a flow-restricting valve that adjusts the amount of fluid passing through the outlet of the fluid pump to generate the fluid resistance; and a rotational governor that controls the flow-restricting valve based on the rotational speed of the sprocket. The power transmitting device comprises a transmission means that transmits the rotational force of the sprocket of the descending device to the crankshaft of the braking device and is designed to apply a braking force to the rotation of the sprocket of the descending device by controlling the flow-restricting valve through the use of the rotational governor to vary the fluid resistance applied to the compressing movement of the pistons in accordance with the rotational speed of the sprocket generated by the weight of the payload when the payload is suspended on the suspension chain.

The braking device further comprises an auxiliary braking device. The auxiliary braking device comprises a casing filled with a fluid, a pump impeller provided in the casing, a turbine runner provided opposed to the pump impeller and movably placed in the casing so that the distance from the pump impeller is variable, and a rotational governor that controls the distance between the pump impeller and the turbine runner in accordance with the rotational speed of the sprocket. The power transmitting device comprises a transmission means that transmits the rotational force of the sprocket of the descending device to the turbine runner of the auxiliary braking device. The descending device further comprises a vertically movable housing placed in an immovable housing. Springs upwardly urges the vertically movable housing. The upper sprocket is held in the vertically movable housing, and the lower sprocket is connected to the ground by means of an anchoring spring. A controlling means is provided in the auxiliary braking means, which narrows the distance in accordance with the downward movement of the vertically movable housing. While the braking device is designed to apply braking force to the rotation of the sprocket of the descending device by controlling the flow-restricting valve through the use of the rotational governor to vary the fluid resistance applied to the compression movement of the pistons in accordance with the speed of the sprocket generated by the weight of a payload when the payload is suspended to the suspension chain, the auxiliary braking device is designed to apply a braking force to the rotation of the sprocket of the descending device, before the pistons of the fluid pump generate a braking force, in accordance with the downward movement of the vertically movable housing caused by the weight of the payload and controlling the distance.

The controlling means is preferably designed so that a link mechanism provided therein moves the turbine runner by mechanically acting in accordance with the downward movement of the vertically movable housing.

The controlling means is also preferably designed to generate a brake force in accordance with the rotational speed of the sprocket so as to lower the payload at a constant rate.

The casing includes the fluid outlet and the fluid inlet, which are connected by the fluid circulating conduit wherein the fluid discharged from the fluid outlet returns to the fluid inlet, and a fluid cooling means is preferably provided in the fluid circulating conduit.

The payload-suspending means is preferably an escape hook for hooking a safety belt that is wrapped around a person's body.

The escape hook is preferably composed of a hook body grooved to receive the chain, a pair of serrated blades pivotally mounted to the hook body so as to move into open or closed positions, elastic bodies providing spring force biased to the direction of the closed position of the serrated blades to clamp the suspension chain received in the chain receiving groove, and a manually operated lever for releasing the suspension chain from the serrated blades by moving the serrated blades to the open position against the spring force provided by the elastic bodies.

A release mechanism is preferably provided in which a hook-shaped arm is horizontally and pivotally mounted to the hook body, with a metal opening portion for the safety belt disposed at the end of the hook-shaped arm. When the hook-shaped arm swings upward from the position that results from a payload being suspended on the metal opening portion for the safety belt, the suspension chain is released from the serrated blades.

Another release mechanism is preferably provided in which a vertically movable impact lever is provided in the hook body such that it protrudes downward from the hook body. When the serrated blades are in the closed position, the impact lever protrudes downward by the resilient force provided from the elastic bodies, and when the impact lever moves upward against the resilient force provided by the elastic bodies, the serrated blades move to the open position and release the hook body from the suspension chain.

PREFERRED EMBODIMENT OF THE INVENTION

An embodiment of the present invention will be described below in more detail with reference to the drawings.

Figure 1:
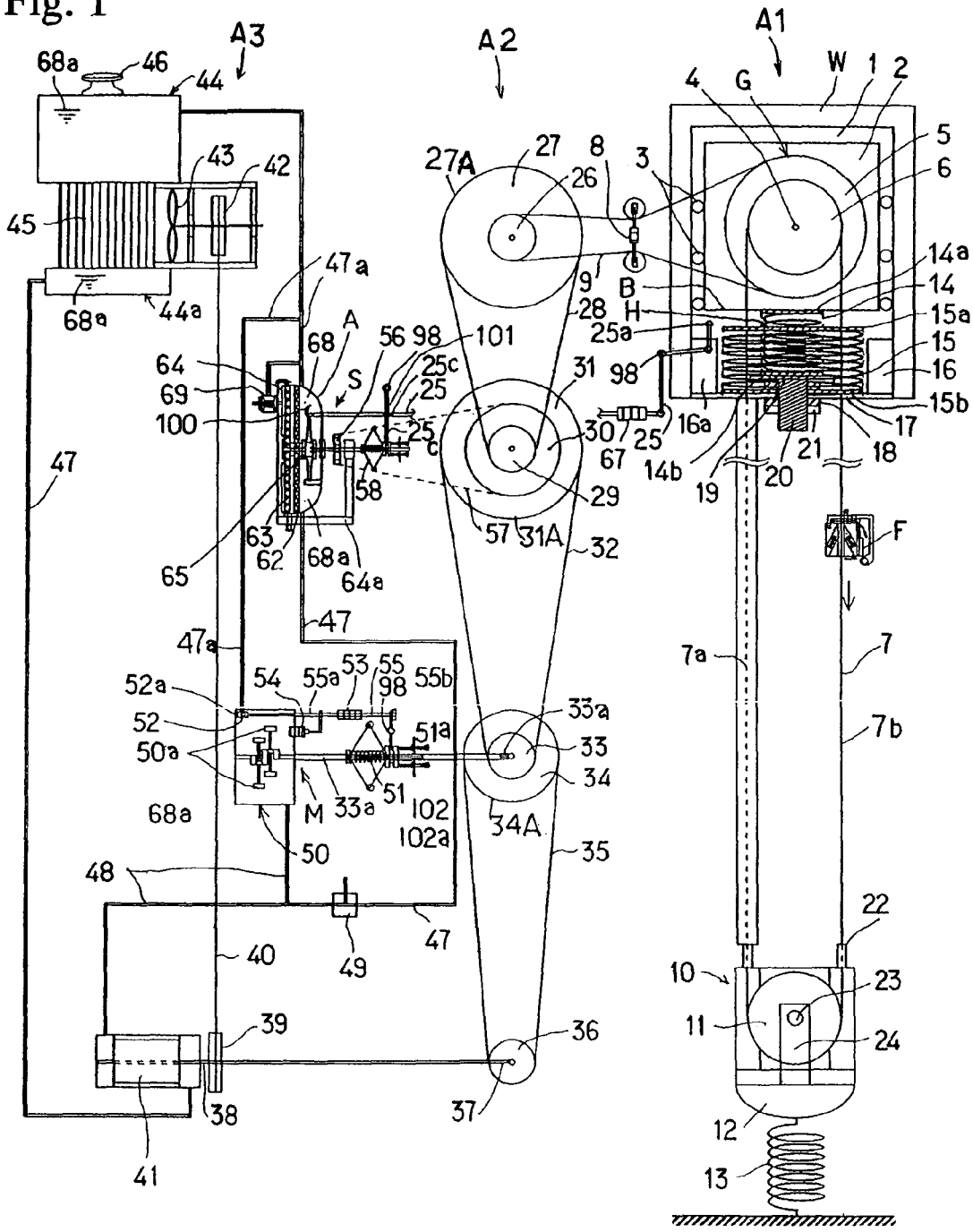
FIG. 1 is a general view showing an embodiment of the present invention.

As shown in FIG. 1, the elevated location descent apparatus comprises a descending device A1 for lowering a payload (for example, a person escaping from a fire), a braking device A3 for maintaining the descending speed of the payload at a constant rate and a power transmitting device A3 that connects the devices A1 and A3.

Figure 2:
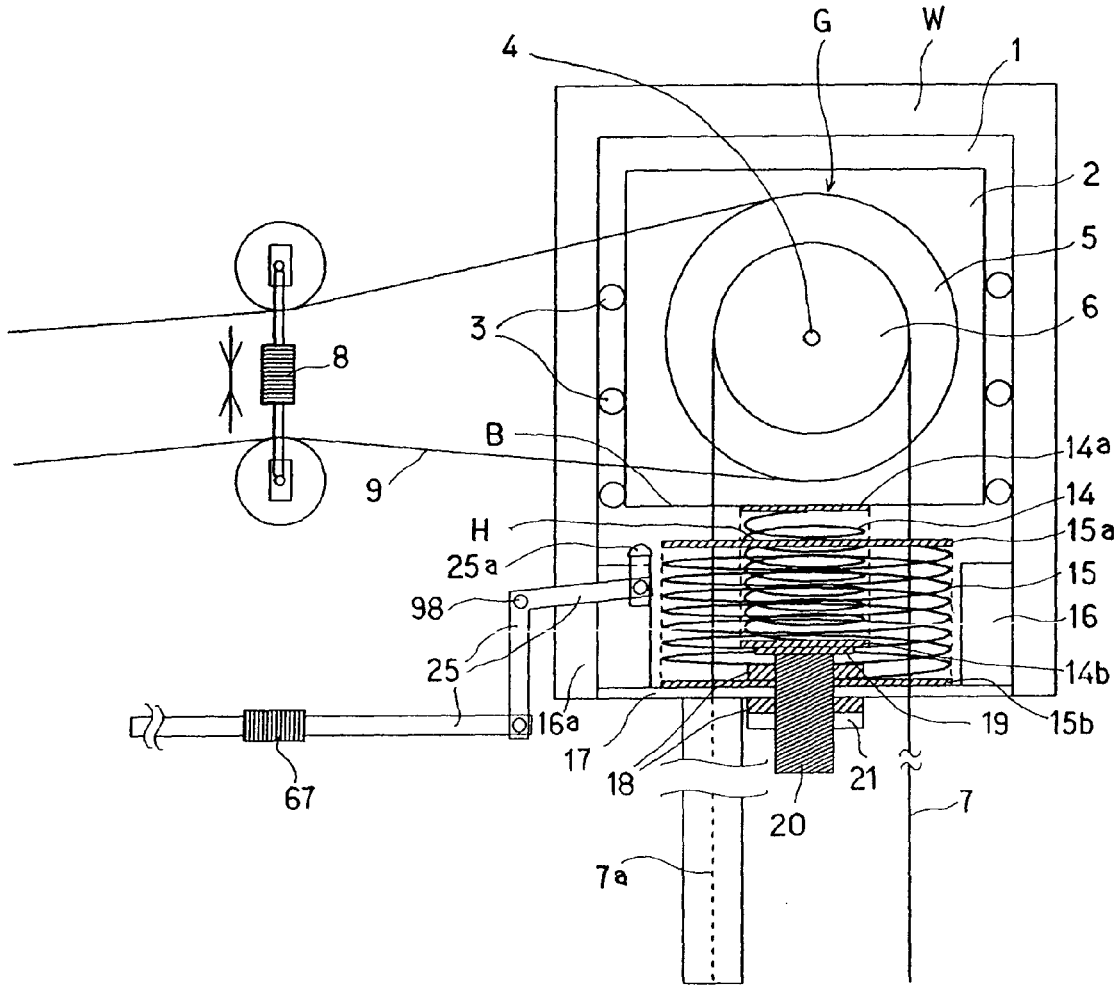
FIG. 2 is a view showing the sprocket and the related parts thereof.

As shown in FIGS. 1 and 2, the descending device A1 comprises a double-sprocket G, a lower sprocket 11, a suspension chain 7 positioned around the sprockets G and 11, and an escape hook F (a payload-suspending means) attached to the suspension chain 7.

An immovable housing W is mounted to a structure, such as the uppermost floor of a building. A vertically movable housing 2 is placed in the immovable housing W so that a space 1 is formed therebetween. A plurality of rollers 3 are rotatably disposed in the space 1, thereby enabling the vertically movable housing 2 to move up and down.

The sprocket G is mounted in the vertically movable housing 2 for rotation on a supporting shaft 4.

The immovable housing W includes a heavy-duty spring 15 (a coil spring) and a light-duty spring 14 (a coil spring) in the bottom part thereof to resiliently support the vertically movable housing 2.

A top plate 15*a* and a base plate 15*b* are provided at the upper and lower ends of the heavy-duty spring 15, respectively. A top plate 14*a* and a base plate 14*b* are also provided at the upper and lower ends of the light-duty spring 14, respectively.

The heavy-duty spring 15 is positioned vertical to a bottom plate 17 of the immovable housing W.

The light-duty spring 14 is longitudinally mounted in the center of the heavy-duty spring 15 and positioned vertical to a backing plate 19 of an adjusting screw bolt 20 described below. The upper part of the light-duty spring protrudes through a hole H which is provided in the top plate 15*a*.

A bottom plate B of the vertically movable housing 2 is positioned on the top plate 14*a*. The vertically movable housing 2 is upwardly forced by the light-duty spring 14.

A nut 18 is secured around a through-bore provided in the bottom plate 17 of the immovable housing W. An adjusting bolt 20 is screwed in the nut 18, and the upper part of the adjusting bolt 20 protrudes into the immovable housing W. The amount of the light-duty spring protruding through the top plate 15*a* can be adjusted by rotating the bolt 20 in the nut 18.

When a plurality of people (with a total weight of, for example, 200 kg) are attached to the suspension chain 7, the vertically movable housing 2 housing the sprocket G moves downward and the light-duty spring is compressed, and when a larger load is applied by more people being attached (with a total weight of, for example, 2 t), the bottom plate B of the vertically movable housing 2 contacts the top plate 15*a* of the heavy-duty spring, and the heavy-duty spring is compressed, thereby exerting a cushioning property. Stoppers 16 and 16*a* are provided in the lower part of the immovable housing W. When the vertically movable housing 2 moves to the lowermost portion, the stoppers 16 and 16*a* receive the vertically movable housing 2 and prevent the housing and other parts from being damaged.

Even when the total weight of the suspension chain 7 varies depending on the length of the suspension chain 7 or the number of the links thereof, the vertically movable housing 2 can be optimally supported.

The lower sprocket 11 is mounted on the suspended housing 10 rotatably on a shaft 32 and support bracket 24. A ballast 12 is provided in the lower part of the suspended housing 10, which is fastened adjacent to the ground by an anchoring spring 13. Thereby, the suspended housing 10 is positioned directly under the sprocket G. To prevent counter-rotation of the suspension chain 7, one side 7*a* of the suspension chain is covered with a suspension chain cover 87, while the other side 7*b* of the suspension chain is not covered. The escape hook F is attached to the uncovered side 7*b* of the suspension chain 7*b*. A hook-releasing projection 22 is provided on the suspended housing 10.

As shown in FIG. 1, the braking device A3 comprises a main braking device M and a brake converter S (an auxiliary braking device). Further, as shown therein, the braking device A3 includes a fluid circulating conduit, which connects the main braking device M and the brake converter S, and in which a fluid 68*a* circulates. The fluid circulating conduit is composed of pipes 47 and 47*a* for low-pressure fluid, a pipe 48 for high-pressure fluid, etc.

Figure 4:
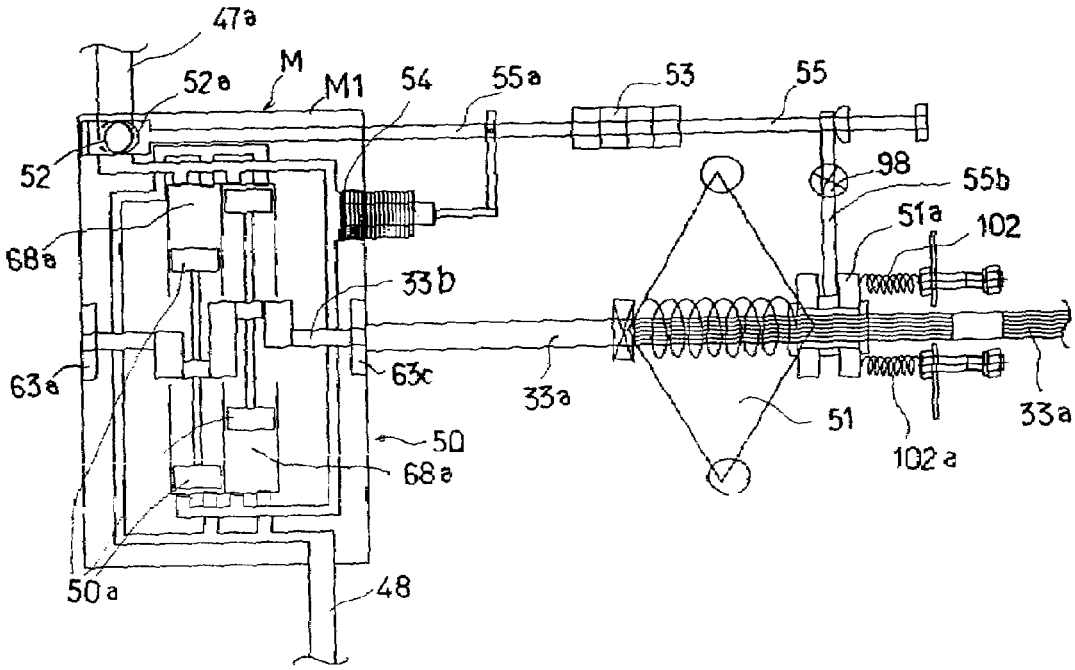
FIG. 4 is a view showing the fluid pump and the related parts thereof.

The main braking device M, as shown in FIG. 4, includes a fluid pump M1 comprising a crankshaft 33*b* and pistons 50*a*. A fluid pump shaft 33*a* is connected to the crankshaft 33*b*. The fluid pump M1 converts the rotational force of the crankshaft 33*b* turned by the fluid pump shaft 33*a* into reciprocal movement and sucks in a fluid 68*a* from an inlet and discharges it from an orifice 52 provided at the end of an outlet. The fluid pump shaft 33*a* is provided with a rotational governor that operates in accordance with its rotational speed. A flow-restricting valve positioned in the orifice 52 of the fluid pump M1 narrows or widens the opening of the orifice 52 by sliding a slidable pipe 52*a*. The flow-restricting valve controls the fluid flow to provide resistance to the compressing movement of the pistons 50*a* and applies braking force to the rotation of the sprocket G via the fluid pump shaft 33*a*.

As shown in FIG. 4, the slidable pipe 52*a* is controlled by a link mechanism composed of links 55, 55*a*, 55*b*, etc. The controlling link 55 can be manually adjusted.

Reference numeral 54 refers to a piston that senses the internal pressure of the fluid pump. This piston is actuated by the fluid pressure exerted by the pistons 50*a* of the fluid pump M1, and generates braking force by engaging the slidable pipe 52*a* through the link 55*a*.

Figure 3:
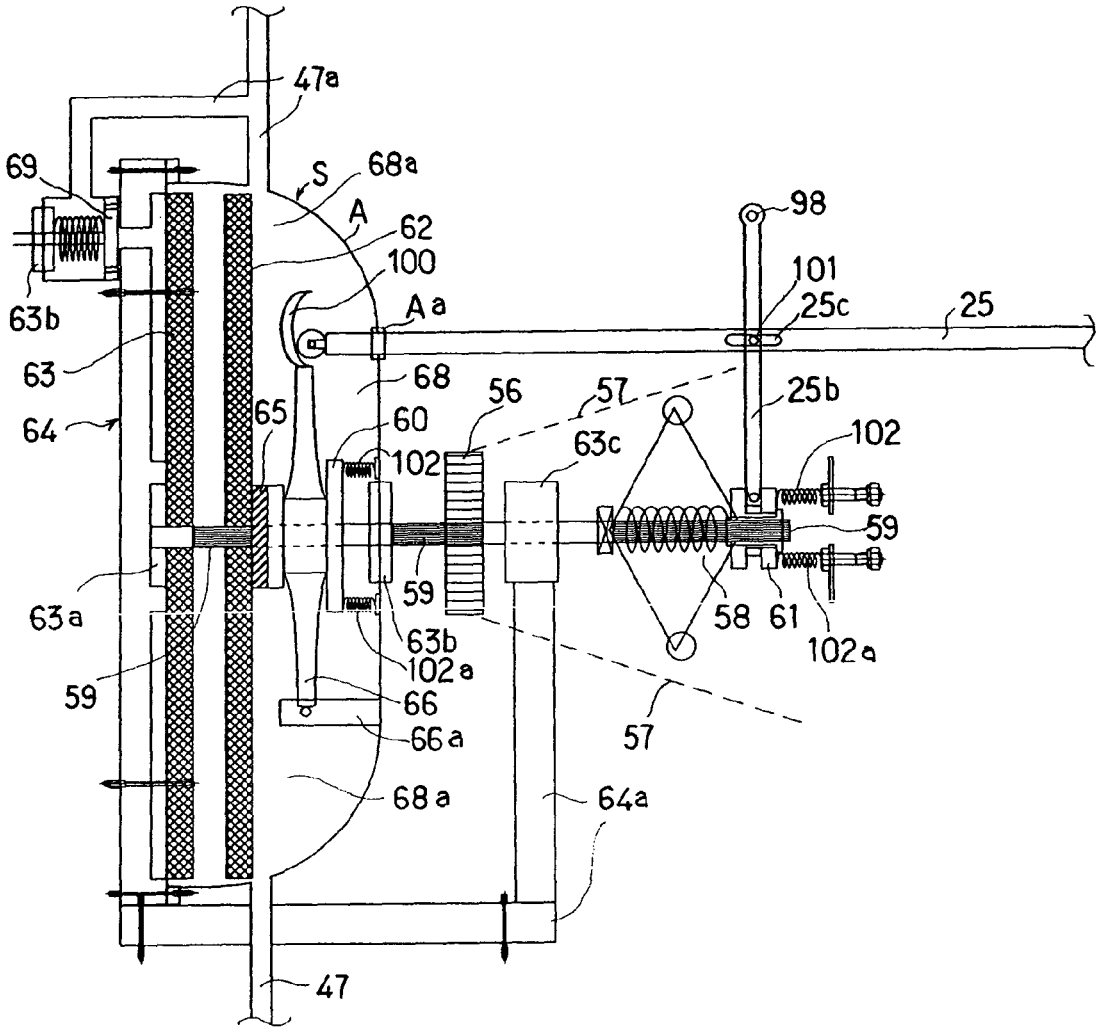
FIG. 3 is a view showing the auxiliary braking device and the related parts thereof.

The brake converter S includes, as shown in FIG. 3, a converter body 64 filled with the fluid 68*a*, a pump impeller 63 provided in the converter body, and a turbine runner 62. The pump impeller 63 is secured to the converter body 64. The turbine runner 62 is mounted on a brake converter shaft 59 in such a way that the turbine runner 62 is axially movable in relation to the brake converter shaft 59 and the distance between the pump impeller 62 and the turbine runner 62 is variable. A rotational governor 58 is installed on the brake converter shaft 59 to operate in accordance with the rotational speed thereof. The rotational governor 58 controls the turbine runner 62 through a link mechanism composed of a control link 25, a collar lever 25*b*, etc. This link mechanism also narrows the distance between the turbine runner 62 and the pump impeller 63 when sensing the downward movement of the vertically movable housing 2 described above.

As shown in FIGS. 1 to 3, one end of the control link 25 penetrates through a fluid seal Aa provided in an auxiliary braking housing A of the converter body 64 and reaches a crescent-shaped receiver 100 provided at the end of a release lever 66 that is equipped with a thrust bearing to control the distance between the pump impeller 63 and the turbine runner 62. The release lever 66 is fitted at the center of a collar 60. The control link 25 also includes a link adjustor 67 and, at the other end thereof, a link head 25*a*. The collar lever 25*b* and the control link 25 crisscross and are connected at a pin 101 provided on the collar lever 25*b*, the pin 101 being slidably mounted on the control link 25 at an elliptical bore 25*c* provided thereon in the axial direction. The reference numeral 64*a* refers to a bearing support, 66*a* refers to a release lever support, 63*b* refers to a seal, and 98 refers to a fulcrum.

As described above, when an escaping person is attached to the descending device A1, the vertically movable housing 2 of the descending device A1 moves downward, the bottom plate B of the vertically movable housing 2 contacts the link head 25*a*, thereby actuating the pump impeller 63, generating rotational resistance between the turbine runner and the fluid 68*a* by narrowing the distance between the turbine runner 62 and the pump impeller 63, and applying a braking force to the rotation of the sprocket G via the brake converter shaft 59. The braking force increases as the distance between the turbine runner 62 and the pump impeller decreases.

The reference numerals 102 and 102*a* refer to adjustment springs.

The fluid-circulating conduit for the fluid 68*a* will be described next. After passing through the main braking device M and the brake converter S, the fluid 68*a* merges via low-pressure pipes 47*a* and is pumped into a fluid reservoir 44. The fluid 68*a* is pumped back to the main braking device M and the brake converter S via the high-pressure pipe 48 and the low-pressure pipe 47.

A fluid-cooling means and a supercharger 41 are disposed in the fluid circulating conduit. The supercharger 41 prevents a shortage of suction fluid in the fluid pump M1 during high-speed rotation, by forcing the fluid 68*a* into the fluid pump M1. The fluid 68*a*, which is heated by the friction that is generated as it travels through the main braking device M and the brake converter S, then passes through a radiator fin 45 that connects a pair of upper and lower fluid tanks 44 and 44*a*, and is cooled by a fan 43.

The main braking device M, the brake converter S and the fluid circulating conduit are constantly filled with the fluid 68*a*. The fluid 68*a* is also replenished from a fluid filler 46 to replace the amount that is naturally lost.

Pure ethylene glycol is used for fluid 68*a*. The use of pure ethylene glycol dramatically improves the anti-freezing property of the fluid 68*a*, and gives an anticorrosion property to the components that contact the fluid 68*a*. Due to its excellent non-combustibility, the fluid 68*a* also prevents the braking function from deteriorating or failing even during use in a fire.

Excessively generated fluid pressure is relieved by a safety valve 69 disposed in the brake converter S.

The power transmitting device A2 will be described next. As shown in FIG. 1, the power transmitting device relays the rotational force of the upper sprocket G of the descending device A1 to the pistons 50*a* of the main braking device M and the turbine runner of the auxiliary braking device S, and comprises a double first sprocket 27A, a triple second sprocket 31A, a double third sprocket 34A and a fourth sprocket 36.

A first transmission chain 9 is positioned around a rear sprocket 5 of the sprocket G of the descending device and a front sprocket 26 of the first sprocket 27A, which has the same diameter as that of the sprocket 5. The tension of the first transmission chain 9 is adjusted by a chain tensioner 8.

The driving force is transmitted from a rear sprocket 27 of the first sprocket 27A to the sprocket 56 mounted on the brake converter shaft of the brake converter S by means of a second transmission chain 28 and a chain 57 via a front sprocket 29 and a middle sprocket 30 of the second sprocket 31A. The driving force is then transmitted to a front sprocket 33 of the third sprocket 34A by means of a third transmission chain 32 via a rear sprocket 31 of the second sprocket 31A. Further, the driving force actuates the rotational governor 51 and the pistons 50*a* of the main braking device M via a spline-fitted sprocket shaft in the center of the third sprocket 34A and the fluid pump shaft 33*a*.

The driving force is transmitted from the rear sprocket 34 of the third sprocket 34A to the fourth sprocket 36 by means of a fourth transmission chain 35, and also transmitted to the supercharger 41 through a sprocket shaft 37 of the fourth sprocket 36 and a rotating shaft of the supercharger.

An cooling fan output sprocket 39 installed on a supercharger rotating shaft 38 transmits the driving force to a cooling fan sprocket 42 via a fifth transmission chain 40 to operate the cooling fan 43.

The operation of the present invention composed as above will be described next. When the escape hook F is attached to the suspension chain 7 of the descending device A1 and an escaping person is suspended therefrom, the weight of the escaping person is applied to the suspension chain 7 and generates the rotational torque of the sprocket G. This rotational torque is transmitted to the sprocket 56 mounted on the brake converter shaft of the brake converter S via the power transmitting device A2, thereby rotating the brake converter shaft 59, actuating the rotational governor 58, operating the pump impeller through the collar lever 25*b* and the control link 25, and generating braking force by narrowing the distance between the turbine runner and the pump impeller.

The rotational torque of the sprocket G is also transmitted to the main braking device via the power transmitting device A2. Braking force is generated by the brake converter S as well as the main braking device M, using the fluid resistance acting on the operation of the pistons 50*a*.

Before the main braking device M generates braking force, the brake converter S may generate braking force by narrowing the distance between the turbine runner 62 and the pump impeller 63 thereof when the above-described link mechanism works in accordance with the downward movement of the vertically movable housing 2, thereby lessening the burden on the main braking device M.

As described above, both the main breaking device M and the brake converter S apply braking force to the sprocket G.

The rotational governors 51 and 58 of the main braking device M and the brake converter S control the braking force by varying the fluid resistance acting on the pistons 50*a* and the rotational resistance of the turbine runner 62 in proportion to the rotational speed of the sprocket G generated by the weight of an escaping person applied to the suspension chain 7. The rotational governors lessen the braking force when the weight of the escaping person is diminished and the rotational speed is decreased. The escaping person can thus be lowered at a safe, steady rate (e.g., about 1.26 m/sec). The descending rate can be suitably changed. When the payload is cargo, the descending speed can be optimally selected for the cargo.

The escape hook F of the descending device A1 will be described next.

Figure 5:
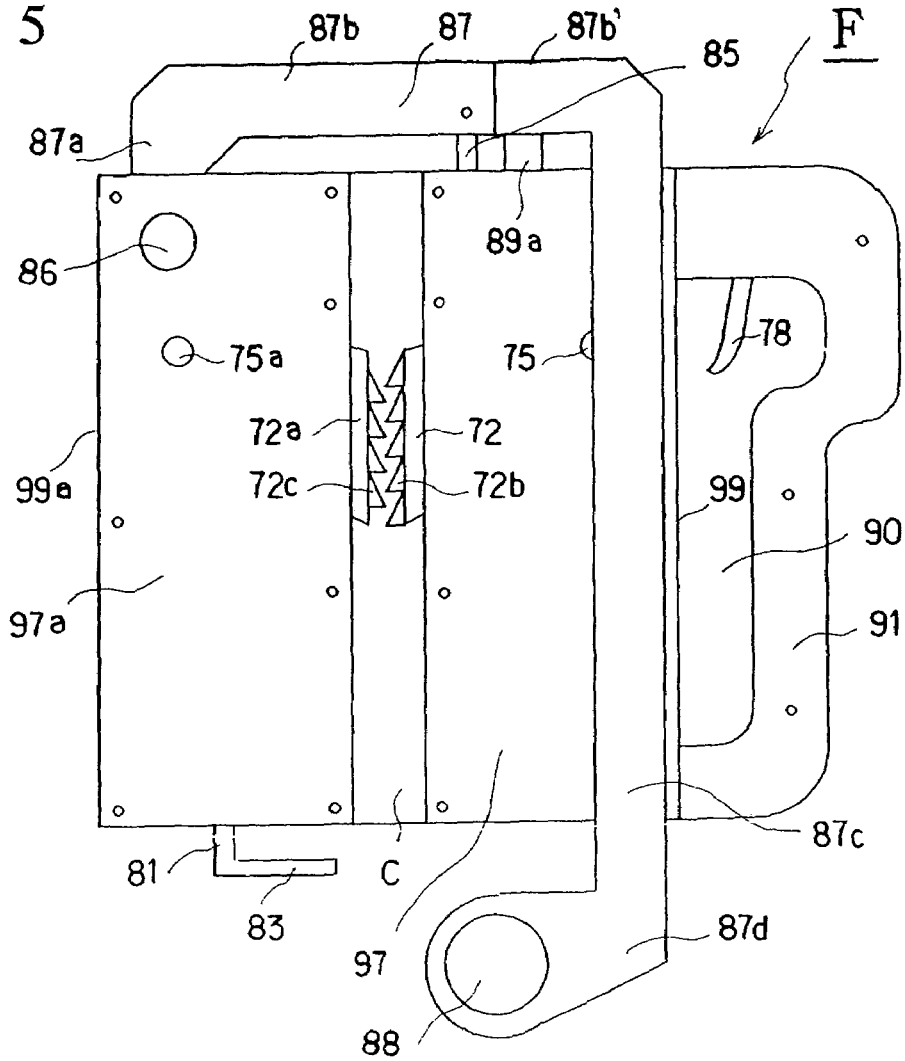
FIG. 5 is a front elevation of the escape hook of the present invention.

The escape hook F includes a hook body having an integrated, multi-layer structure comprising a boundary plate Fc having an H-shape when viewed planarly, a front member Fa placed anterior to the boundary plate Fc, a rear member Fb placed posterior thereto, front plates 97 and 97*a* placed anterior to the front member Fa, and a back plate 92 placed posterior to the rear member Fb. The form, function, etc., of the escape hook F will be described in detail next. FIG. 5 shows the front elevation of the complete escape hook F, FIG. 6 is the plan view thereof, and FIGS. 7 and 8 show the escape hook F without the front plates 97 and 97*a*, and the escape hook F without the back plate 92, respectively.

Figure 6:
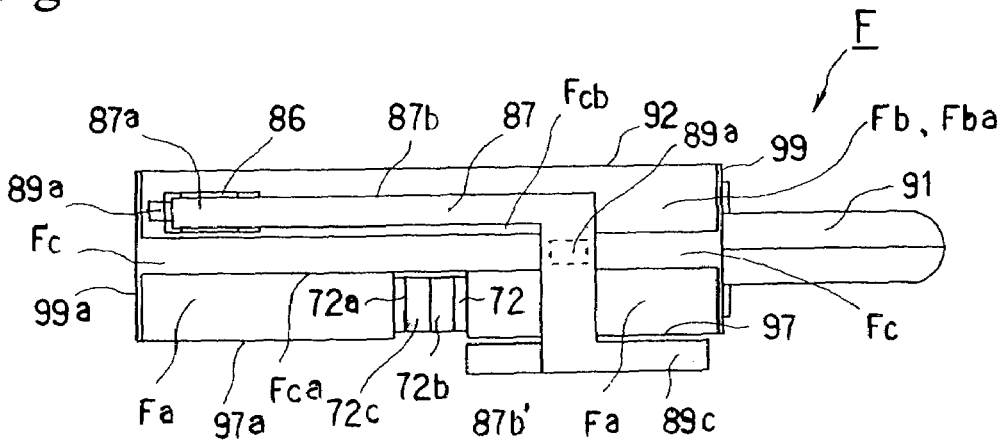
FIG. 6 is a plan view of the escape hook of the present invention.
Figure 7:
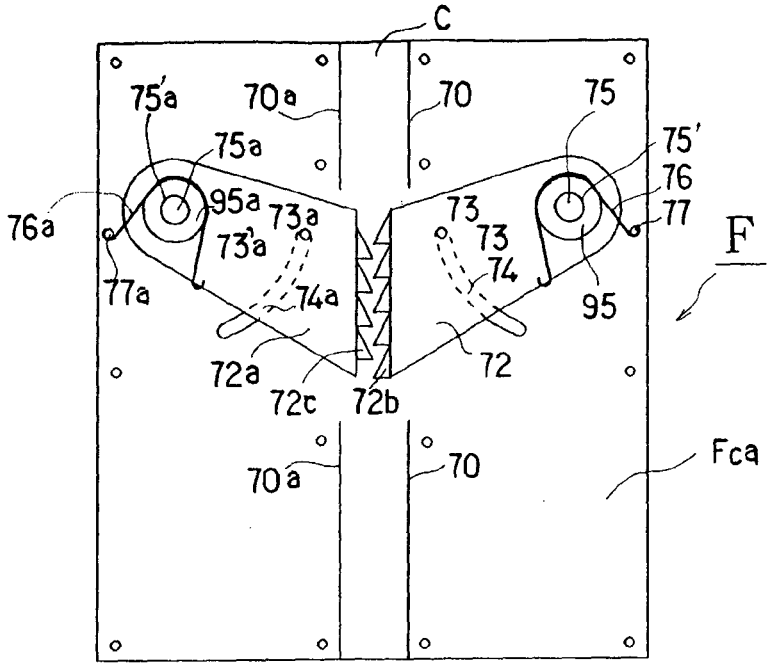
FIG. 7 is a front elevation of the escape hook without the front plate.
Figure 8:
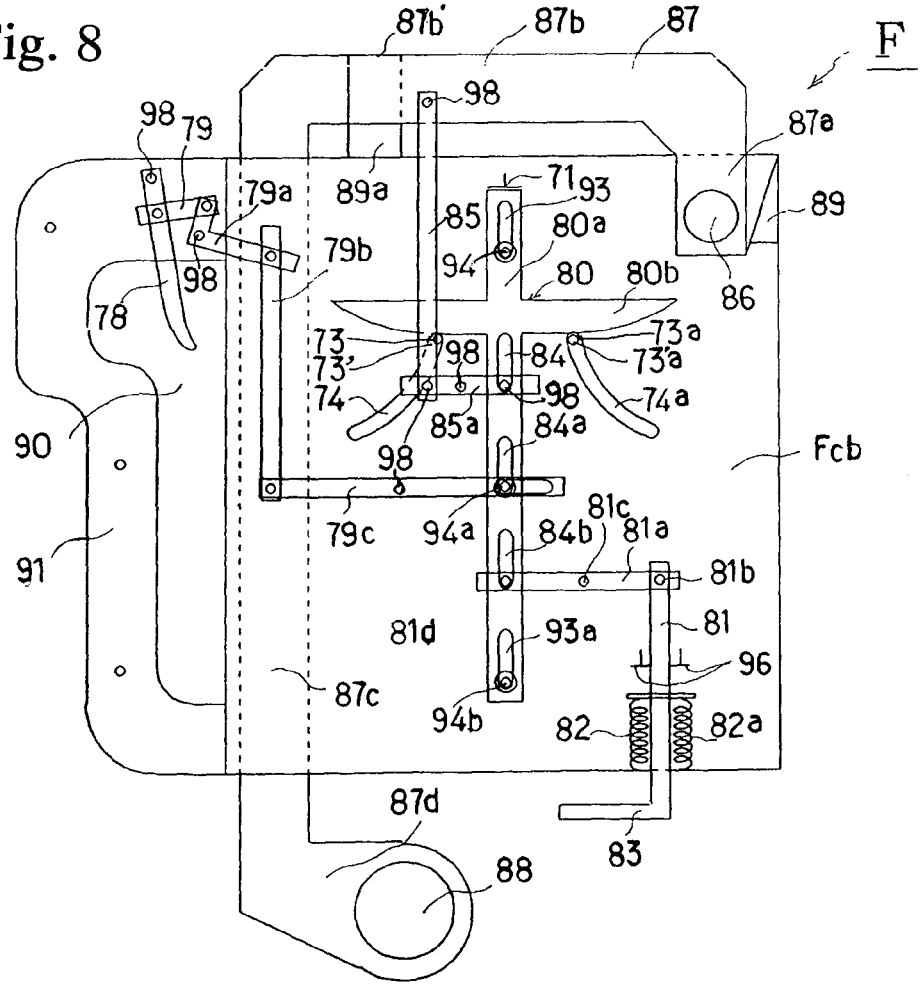
FIG. 8 is a rear elevation of the escape hook without the base plate.

As shown in FIGS. 5 to 7, a chain receiving groove C is formed on the front member Fa by providing a space between side plates 70 and 70*a*. The chain receiving groove C is longitudinally formed at the front center of the front member Fa so as to receive the suspension chain (roller chain) 7 in a manner that allows the suspension chain 7 to move vertically, the roller surfaces of the suspension chain 7 facing the side plates 70 and 70*a*. The front member Fa includes pedestal metals 72 and 72*a* having serrated blades 72*b* and 72*c*, respectively, at the end thereof. The pedestal metals are arranged so that the serrations of the serrated blades 72*b* and 72*c* alternatively protrude against the suspension chain 7 received in the chain receiving groove C, thereby clamping the rollers of the suspension chain 7.

The pedestal metals 72 and 72*a* are shaped somewhat like two bell-shaped lanterns with their bottom portions facing each other. Circular holes 75' and 75'*a* are provided at substantially the center of the base of each pedestal metal 72 and 72*a*. The pedestal metals 72 and 72*a* are pivotally mounted to the front member Fa by inserting pins 75 and 75*a* to the circular holes 75' and 75*a*. To clamp the suspension chain 7 received in the chain receiving groove c by the serrated blades 72*b* and 72*c*, rolled springs 78 and 76*a* are positioned around the pins 75 and 75*a*. One end each of the rolled springs 78 and 76*a* is hooked to the pedestal metals 72 and 72*a*, and the other end thereof is hooked to hooking pins 77 and 77*a*, respectively.

Circular holes 73' and 73'*a* are provided in the previously described hook body. The circular holes 73' and 73'*a* are situated between circular hole 75' and the side plate 70 and between circular hole 75'*a* and the side plate 70*a*, respectively, penetrating the boundary plate Fc and reaching the back plate 92 of the rear member Fb.

Guide channels 74 and 74*a* for the pedestal metals 72 and 72*a* are symmetrically disposed in relation to a cross-shaped slidable flat link 80 in the boundary plate Fc and located under the pedestal metals 72 and 72*a*, extending from the position of circular holes 73' and 73'*a* to the extent of 90 degrees around pins 75 and 75*a*.

Guide pins 73 and 73*a* are provided in the pedestal metals 72 and 72*a*, respectively. These guide pins are inserted in the circular holes 73' and 73'*a*. The protruding length of the guide pins 73 and 73*a* is set to be a little longer than the thickness of the horizontally extending portion of the cross-shaped link member 80*b* provided on the rear member Fb as described below and shown in FIG. 8.

FIG. 8 shows the elevational view of the rear member Fb. This rear member Fb receives a hook-shaped arm 87 for smooth mounting to and operation of a safety belt (not shown) that is rolled around the waist, etc., of an individual and that integrally functions with the front member Fa. As shown in FIGS. 6 and 8, the hook-shaped arm 87 comprises a head member 87*a*, a horizontal member 87*b*, a vertical member 87*c* and a tail member 87*d* having a metal opening portion 88 for the safety belt. The head member 87*a* of the hook-shaped arm 87 is pivotally mounted to the boundary plate Fc by the installation pin 86 at the upper corner of the rear side of the rear member Fba. The horizontal member 87*b* is positioned over the rear member Fba, extends past the arm stopper 89 projecting from the boundary plate Fc, curves toward the direction of the upper edge of the front plate 97*a* and curves toward the right past the upper edge of the front plate 97*a* (see FIGS. 5 and 6). The vertical member 87*d* curves downward shortly before the right longitudinal edge of the front plate 97*a* and curves to the left past the lower edge of the front plate 97*a* (see FIG. 5). The tail member 87*d* extends to such a length that it will not contact the suspension chain 7.

As shown in FIG. 5, in consideration of the weight balance, the tail member 87*d* is bent inward to prevent tilting caused by the weight of an escaping person when the escape hook F is in use.

An upper limit stopper 71 for the cross-shaped link is provided at the longitudinal upper end of and in the middle of the back plate Fcb of the boundary plate in the rear member Fb. Five longitudinal slots, 93, 84, 84*a* 84*b* and 93*a*, are disposed at equal intervals from the top to the bottom of the cross-shaped slidable flat link 80. The horizontal part

80*b* of the cross-shaped slidable flat link 80 is mounted on the guide pins 73 and 73*a* of the front member Fa.

Screws 94, 94*a* and 94*b* provided with washers having a diameter larger than the width of the longitudinal slots are inserted in the uppermost and lowermost longitudinal slots 93 and 93*a* of the cross-shaped slidable flat link 80. The tips of the washer-provided screws are screwed to the back plate Fcb of the boundary plate, thus allowing the cross-shaped slidable flat link 80 to move via the back plate Fcb of the boundary plate in the longitudinal direction of longitudinal slots 93 and 93*a*, i.e., vertically movable with respect to the longitudinal slots 93, 84, 84*a*, 84*b* and 93*a*. The cross-shaped slidable flat link 80 is urged downwardly by impact lever return springs 82 and 82*a*.

When a hook-releasing impact plate 83 is pushed upward, i.e., when the escape hook F attached to the suspension chain 7 is lowered and the impact plate 83 thereof is pushed upward by contacting the hook-releasing projection 22 of the suspended housing 10, the hook-releasing impact lever 81 and a horizontal link 81*a* for the hook-releasing impact lever move vertically via a central fulcrum 81*c*, a power point 81*b*, an application point 81*d* for the hook-releasing impact lever link, etc. This movement shifts the cross-shaped slidable flat link 80 within the slidable range of the longitudinal slots 93, 84, 84*a*, 84*b* and 93*a* to open the serrated blades 72*b* and 72*c* of the pedestal metals 72 and 72*a* in a diagonally downward direction, thereby releasing the escape hook F from the suspension chain 7. As described above, the escape hook F can be attached to and removed from the suspension chain 7 by vertically moving the cross-shaped slidable flat link 80. Further, the impact lever return springs 82 and 82*a* urges the hook-releasing impact plate 83 downwardly.

In order to manually release the escape hook F from the suspension chain 7, the hook F must be free from the weight of the escaping person.

As shown in FIG. 8, a link mechanism comprising a flat link 79, an L-shaped flat link 79*a*, a flat link 79*b* and a flat link 79*c* is coupled to the manual release lever 78. The escape hook F can be released from the suspension chain 7 by pulling the manual release lever 78 toward the hook body handle 91, thereby pushing the cross-shaped slidable flat link 80 downward via the link fulcrum 98. A space 90 is provided between the handle 91 and a side panel 99*a* to allow a person's fingers to operate the manual release lever 78.

The escape hook F is used as follows:

An escaping person securely fastens a safety belt to his or her body, holds the handle 91 attached to the body of hook F, attaches the metal clip of the safety belt to the safety belt metal opening portion 88 of the hook F, and pulls the manual release lever 78 toward the handle 91 with the fingers to move the serrated blades 72*b* and 72*c* to the open position, thereby creating a space to receive the suspension chain 7 in the chain receiving groove C provided in the front part of the escape hook F. When the escaping person releases the fingers from the manual release lever 78, the serrated blades 72*b* and 72*c* clamp from the right and left the suspension chain 7 received in the chain receiving groove C, readying the escaping person for descending. Then, the escaping person jumps into the air to be lowered at a safe descending rate. If the escaping person needs to wait before jumping into the air, he or she can wait with the hook F attached to the suspension chain 7 even while the chain is in operation because the serrated blades 72*c* and 72*b* of the pedestal metals 72 and 72*a* in the escape hook F serve as a one-way clutch due to their orientation and the direction of resilient force provided by the rolled springs 76 and 78*a*, as shown in the FIGS. 5 and 6. Thus, an escaping person who is waiting to be lowered will not be accidentally dragged down by the operating suspension chain 7 when another escaping person from a different floor is being lowered. Further, the escape hook F can be safely attached even while the suspension chain 7 is in operation.

In the manner described above, an escaping person is lowered by attaching the escape hook F to the suspension chain 7. When the escaping person reaches the ground, the impact plate 83 is pressed to the ground and the escape hook F is automatically released from the suspension chain 7. If there is a safe place before reaching the ground and the escaping person lands on the safe place, the suspension chain 7 stops. Moreover, the hook-shaped arm 87 pivots around the installation pin 88 due to the downward inertia of the escape hook F, and the safety belt metal opening portion 88 of the hook-shaped arm 87 is pulled upward in an arc shape. Consequently, the cross-shaped slidable flat link 80 moves downward by means of the arm links 85 and 85*a* for opening and closing the serrated blades. This makes the serrated blades 72*b* and 72*c* open, and the escape hook F is automatically released from the chain 7. The links 85 and 85*a* are connected to each other by a pin. The link 85*a* is connected to the hook body by a pin 98 as to allow it to freely move in a see-saw manner. One end of the link 85 is connected to the hook-shaped arm 87 by a pin 98, and a pin 98 provided at one end of the link 85*a* is slidably inserted into the longitudinal slot 84 of the cross-shaped slidable flat link 80.

When the hook F is free from the weight of the escaping person, the escaping person or another person can manually release the hook F from the chain 7 by gripping and pulling the manual release lever 78 toward the handle 91.

The components of the apparatus of the present invention are all preferably formed from metal. A cold-resistant suspension chain 7 is to be used in extremely cold regions. A plurality of the escape hooks F should be provided at every floor of the building. The escape hook F is designed to withstand the weight of, e.g., 200 kg (the weight of 3 adults).

The elevated location descent apparatus is mounted to the outside of a building adjacent to a window or the like where people at each floor have easy access to the outside. The suspension chain 7 is suspended from the outside of the uppermost floor to the ground, and the sprocket G, etc., is positioned as previously described to a structure such as an uppermost floor or a roof.

The descending device A1, braking device A3, and power transmitting device A2, without the suspension chain 7 and 7*a*, the suspended housing 10, the hook F, etc., are stored in a suitably-sized storage boxes.

The elevation descend device of the present invention is composed as described above, and offers numerous effects described below.

(1) The apparatus employs the weight of an escaping person as an energy source for descend, not relying on a driving motor. Therefore, the apparatus is highly economical. The apparatus does not require electric power and, thus, is not affected by power failures. Moreover, the apparatus is cost-effective due to the easy and inexpensive production thereof.

(2) Regardless of age, gender or physical disability, an individual with a healthy hand can descend very safely and securely.

(3) Due to the continuous operation of the suspension chain, a single unit of the apparatus enables a plurality of people to be lowered from one place. Moreover, many people (e.g., about 20 people) can be lowered in a short period of time.

(4) Regardless of the height of a building, an individual at any floor can be readily lowered if he/she has access to an escapeway, such as a window. Even when the apparatus is in operation, the escape hook can be attached to the suspension chain, and thereby the efficiency of descending is improved.

(5) The apparatus is advantageous with respect to maintenance, etc., because its parts are not subject to abrasion, it has high durability, and it has a mechanical structure that will reduce malfunctions.

(6) The apparatus requires little space for installation (for example, an area of 1 square meter or less).

(7) The apparatus operates properly under temperature conditions of, for example, −40° C. to 60° C. due to the use of ethylene glycol for the fluid. Ethylene glycol provides all-weather operation and exhibits corrosion-proofing and non-combustive effects.

(8) An individual can exit the apparatus at a mid floor before reaching the ground, and thus he/she can reach a safe place sooner. An individual can also use the apparatus from a mid floor. Thus, the descending efficiency is further improved.

(9) The apparatus is designed for safe, secure, accident-free operation. Regardless of physical strength, age and gender, anyone can use the apparatus.

(10) The escape hook is easily attached to and removed from the suspension chain. Thus, the safety and efficiency of descending are further improved.

(11) In addition to humans, cargo can be lowered safely and efficiently.

The invention claimed is:

1. An elevated location descent apparatus comprising a descending device, a braking device and a power transmitting device, the descending device comprising sprockets positioned in a vertical plane, a suspension chain positioned around the sprockets and a payload-suspending means attached to the suspension chain, the braking device comprising a fluid pump converting the rotational movement of a crankshaft into the reciprocal movement of pistons, which reciprocal movement causes the fluid pump to receive a fluid from an inlet and discharge the fluid through an outlet, a fluid circulating conduit connecting the outlet of the fluid pump with the inlet of the fluid pump in which the fluid discharged from the fluid pump circulates, a flow-restricting valve adjusting the amount of the fluid passing through the outlet of the fluid pump to generate the fluid resistance, and a rotational governor controlling the flow-restricting valve based on the rotational speed of the sprocket, the power transmitting device comprising a transmission means that transmits the rotational force of the sprocket of the descending device to the crankshaft of the braking device, the elevated location descent apparatus being designed to apply braking force to the rotation of the sprocket of the descending device by controlling the flow-restricting valve through the use of the rotational governor to vary the fluid resistance applied to the compressing movement of the pistons in accordance with the rotational speed of the sprocket generated by the weight of a payload when the payload is attached to the suspension chain.

2. An elevated location descent apparatus according to claim 1, wherein the braking device further comprises an auxiliary braking device, the auxiliary braking device comprising a casing filled with the fluid, a pump impeller provided in the casing, a turbine runner provided opposed to the pump impeller and movably placed in the casing so that the distance from the pump impeller is variable and a rotational governor controlling the distance between the pump impeller and the turbine runner in accordance with the rotational speed of the sprocket, the power transmitting device further comprises a transmission means that transmits the rotational force of the sprocket of the descending device to the turbine runner of the auxiliary braking device, the descending device further comprises a vertically movable housing placed in an immovable housing, the vertically movable housing being upwardly urged by springs, an upper sprocket being held in the vertically movable housing, and a lower sprocket being connected to the ground by means of an anchoring spring, and the auxiliary braking means further comprises a controlling means narrowing the distance in accordance with the downward movement of the vertically movable housing, the braking device being designed to apply braking force to the rotation of the sprocket of the descending device by controlling the flow-restricting valve through the use of the rotational governor to vary the fluid resistance applied to the compressing movement of the pistons in accordance with the rotational speed of the sprocket generated by the weight of a payload when the payload is suspended to the suspension chain, and the auxiliary braking device being designed to apply braking force to the rotation of the sprocket of the descending device, before the pistons of the fluid pump generate braking force, in accordance with the downward movement of the vertically movable housing caused by the weight of the payload and narrowing the distance.

3. An elevated location descent apparatus according to claim 2 wherein the controlling means comprises a link mechanism and is designed to move the turbine runner by mechanically acting in accordance with the downward movement of the vertically movable housing.

4. An elevated location descent apparatus according to claim 1, further configured to generate braking force in accordance with the rotational speed of the sprocket so as to lower the payload at a constant rate.

5. An elevated location descent apparatus according to claim 2, wherein a fluid outlet and a fluid inlet provided in the casing are connected by a fluid circulating conduit in which the fluid discharged from the fluid outlet of the casing returns to the fluid inlet of the casing, and a fluid cooling means is provided in the fluid circulating conduit.

6. An elevated location descent apparatus according to claim 1, wherein the payload-suspending means is an escape hook for hooking a safety belt rolled around a human body.

7. An elevated location descent apparatus according to claim 6 wherein the escape hook comprises a hook body grooved to receive the chain, a pair of serrated blades pivotally mounted to the hook body so as to move to open or closed positions, elastic bodies providing spring force to the direction of the closed position of the serrated blades to clamp the suspension chain received in the chain receiving groove and a lever for releasing the suspension chain from the serrated blades by moving the serrated blades to the open position against the spring force provided by the elastic bodies.

8. An elevated location descent apparatus according to claim 7 further comprising a release mechanism in which a hook-shaped arm is horizontally and pivotally mounted to the hook body, with a metal opening portion for the safety belt disposed at the end of the hook-shaped arm, so that when the hook-shaped arm swings upward from a position that results from a payload being suspended on the metal opening portion for the safety belt, the suspension chain is released from the serrated blades.

9. An elevated location descent apparatus according to claim 7, further comprising a release mechanism in which a vertically movable impact lever is provided in the hook body so that it protrudes downward from the hook body in such a way that when the serrated blades are in the closed position, the impact lever protrudes downward by the spring force provided from the elastic bodies, and when the impact lever moves upward against the spring force provided by the elastic bodies, the serrated blades move to the open position and release the hook body from the suspension chain.

10. An elevated location descent apparatus according to claim 2, further configured to generate braking force in accordance with the rotational speed of the sprocket so as to lower the payload at a constant rate.

11. An elevated location descent apparatus according to claim 3, further configured to generate braking force in accordance with the rotational speed of the sprocket so as to lower the payload at a constant rate.

12. An elevated location descent apparatus according to claim 3, wherein a fluid outlet and a fluid inlet provided in the casing are connected by a fluid circulating conduit in which the fluid discharged from the fluid outlet of the casing returns to the fluid inlet of the casing, and a fluid cooling means is provided in the fluid circulating conduit.

13. An elevated location descent apparatus according to claim 4, wherein a fluid outlet and a fluid inlet provided in the casing are connected by a fluid circulating conduit in which the fluid discharged from the fluid outlet of the casing returns to the fluid inlet of the casing, and a fluid cooling means is provided in the fluid circulating conduit.

14. An elevated location descent apparatus according to claim 2, wherein the payload-suspending means is an escape hook for hooking a safety belt rolled around a human body.

15. An elevated location descent apparatus according to claim 3, wherein the payload-suspending means is an escape hook for hooking a safety belt rolled around a human body.

16. An elevated location descent apparatus according to claim 4, wherein the payload-suspending means is an escape hook for hooking a safety belt rolled around a human body.

17. An elevated location descent apparatus according to claim 5, wherein the payload-suspending means is an escape hook for hooking a safety belt rolled around a human body.

18. An elevated location descent apparatus according to claim 8, further comprising a release mechanism in which a vertically movable impact lever is provided in the hook body so that it protrudes downward from the hook body in such a way that when the serrated blades are in the closed position, the impact lever protrudes downward by the spring force provided from the elastic bodies, and when the impact lever moves upward against the spring force provided by the elastic bodies, the serrated blades move to the open position and release the hook body from the suspension chain.

* * * * *